US010258124B2

(12) United States Patent
Watson

(10) Patent No.: US 10,258,124 B2
(45) Date of Patent: Apr. 16, 2019

(54) CLOTHING ACCESSORY ORGANIZATION DEVICE

(71) Applicant: Terrance Watson, Warner Robins, GA (US)

(72) Inventor: Terrance Watson, Warner Robins, GA (US)

( * ) Notice: Subject to any disclaimer, the term of this patent is extended or adjusted under 35 U.S.C. 154(b) by 0 days.

(21) Appl. No.: 15/401,667

(22) Filed: Jan. 9, 2017

(65) Prior Publication Data

US 2017/0196330 A1 Jul. 13, 2017

Related U.S. Application Data

(60) Provisional application No. 62/275,897, filed on Jan. 7, 2016.

(51) Int. Cl.

| | |
|---|---|
| ***A45C 11/16*** | (2006.01) |
| ***A45C 13/02*** | (2006.01) |
| ***A47G 29/08*** | (2006.01) |
| *A47B 88/994* | (2017.01) |
| *A47F 7/02* | (2006.01) |
| *A47B 61/00* | (2006.01) |

(52) U.S. Cl.

CPC ..... *A45C 11/16* (2013.01); *A45C 13/02* (2013.01); *A47G 29/08* (2013.01); *A45C 2013/026* (2013.01); *A47B 61/003* (2013.01); *A47B 88/994* (2017.01); *A47F 7/02* (2013.01)

(58) Field of Classification Search

CPC ..... A45C 11/16; A45G 25/447
USPC ..... 206/278, 284, 523, 565, 566
See application file for complete search history.

(56) References Cited

U.S. PATENT DOCUMENTS

| | | | | | |
|---|---|---|---|---|---|
| 1,477,481 | A * | 12/1923 | Haerr | A45C 13/02 | 206/565 |
| 1,870,305 | A * | 8/1932 | Wheary | A47B 61/06 | 190/13 F |
| 3,175,658 | A * | 3/1965 | Bierman | A45C 3/004 | 190/110 |
| 3,421,634 | A * | 1/1969 | Huth | A47B 81/00 | 206/561 |
| 3,550,890 | A * | 12/1970 | Kemp | A47G 29/08 | 248/206.4 |
| 3,704,778 | A * | 12/1972 | Raschdorf | A47G 25/54 | 206/287 |

(Continued)

*Primary Examiner* — Sue A Weaver
(74) *Attorney, Agent, or Firm* — Global Intellectual Property Agency, LLC; Daniel Boudwin

(57) ABSTRACT

A clothing accessory organization device. The clothing accessory organization device includes a housing with a base and one or more sidewalls forming an interior volume with an open upper end. Several storage compartments are placed within the interior volume through the upper end and are sized so that the positioning of the storage compartments may be easily rearranged within the interior volume. One or more retractable J-shaped hooks are placed within the housing and designed to slide between a retracted position and an extended position. The J-shaped hooks are adapted to hang the clothing accessory organization device from a flat surface when in the extended position, such as from the top of a door. The invention may also be positioned on a horizontal surface, such as on dresser top or within a drawer. Additionally, a retractable handle is located within a sidewall for easy transportation.

15 Claims, 4 Drawing Sheets

(56) References Cited

U.S. PATENT DOCUMENTS 3,930,702 A * 1/1976 Pichowicz ..... A45C 11/16 312/245
4,703,850 A * 11/1987 Walker ..... A45C 3/12 206/288
4,854,656 A * 8/1989 O'Keefe ..... A45C 11/16 312/334.23
4,966,287 A * 10/1990 Snyder ..... A45C 11/16 211/113
D330,219 S 10/1992 Carlson et al.
5,273,154 A * 12/1993 Braun ..... A45C 11/16 206/495
5,511,873 A * 4/1996 Mech ..... A45C 11/16 206/566
5,551,772 A * 9/1996 Keffer ..... A47F 7/02 206/6.1
5,628,398 A * 5/1997 Jackson ..... A45C 3/004 190/109
5,671,849 A * 9/1997 Bacon ..... A47F 7/02 206/6.1
6,129,433 A 10/2000 Rosenberg et al.
6,467,622 B1 10/2002 Hull
6,834,924 B2 12/2004 Hollenstein
7,066,563 B2 6/2006 Berger
7,163,119 B2 1/2007 Besselman
7,389,868 B2 * 6/2008 Lewand ..... A45C 11/16 206/495
7,757,844 B2 * 7/2010 Mobley ..... A45C 11/16 206/566
8,210,387 B2 * 7/2012 Twig ..... B25H 3/023 220/521
2005/0011793 A1 * 1/2005 Sapyta ..... A45C 7/0095 206/459.5
2006/0037824 A1 * 2/2006 Park ..... A45C 13/03 190/110
2006/0137949 A1 * 6/2006 Levinson ..... A45C 5/14 190/18 A
2006/0207697 A1 * 9/2006 Greiner ..... A45C 7/0095 150/113
2007/0164643 A1 * 7/2007 Greiner ..... A45C 11/16 312/227
2009/0078591 A1 * 3/2009 Hofman ..... A45C 11/008 206/77.1
2013/0299363 A1 * 11/2013 De Lecce ..... A47F 3/14 206/6.1
2014/0263116 A1 * 9/2014 Wojciechowski .... A47F 5/0807 211/85.2

* cited by examiner

CLOTHING ACCESSORY ORGANIZATION DEVICE

CROSS REFERENCE TO RELATED APPLICATIONS

This application claims the benefit of U.S. Provisional Application No. 62/275,897 filed on Jan. 7, 2016. The above identified patent application is herein incorporated by reference in its entirety to provide continuity of disclosure.

BACKGROUND OF THE INVENTION

The present invention relates to organization devices. More specifically, the present invention relates to clothing accessory storage devices designed to frictionally hold multiple clothing accessories within a housing, and have the housing suspended vertically from a flat surface, such as the top of a door, for compact storage.

Clothing accessories are used by many individuals not only for functional reasons, such as a belt to hold up a pair of pants, but also to compliment outfits and express individuality, such as jewelry. Many people may own several watches, belts, pairs of sunglasses and pieces jewelry and require a place to store them when not being worn or used. Because these items each have different shapes and sizes, it can be challenging to store them in an organized fashion. Attempting to store all of these items within a single drawer can be chaotic and frustrating, making it difficult to view the accessories all at once in order to make a decision regarding what to wear.

Additionally, some people may have limited drawer space to allocate to such items. This can lead to a disorganized array of accessories spread across a dresser top or similar available surface. Accordingly, a device designed to store such clothing accessories in an organized manner while being adapted to be used both on a horizontal surface, such as on top of a dresser or within a drawer, as well as being adapted to hang from a door in order to save space, is desired.

SUMMARY OF THE INVENTION

In view of the foregoing disadvantages inherent in the known types of organization devices now present in the known art, the present invention provides a clothing accessory organization device wherein the same can be utilized for providing convenience for the user when wishing to store clothing accessories in an organized manner. The present system comprises a housing having a base and one or more sidewalls forming an interior volume with an open upper end. A plurality of storage compartments are removably disposed within the interior volume and are dimensioned so that the positioning of the storage compartments may be easily rearranged within the interior volume. One or more retractable J-shaped hooks are placed within the housing and are configured to slide between a retracted position within the interior volume and an extended position exterior to the housing. The clothing accessory organization device may be used in a horizontal position, such as within a drawer, while the J-shaped hooks allow it to by hung vertically, such as from the top surface of a door. Additionally, a retractable handle is located within a side all for easy transportation.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
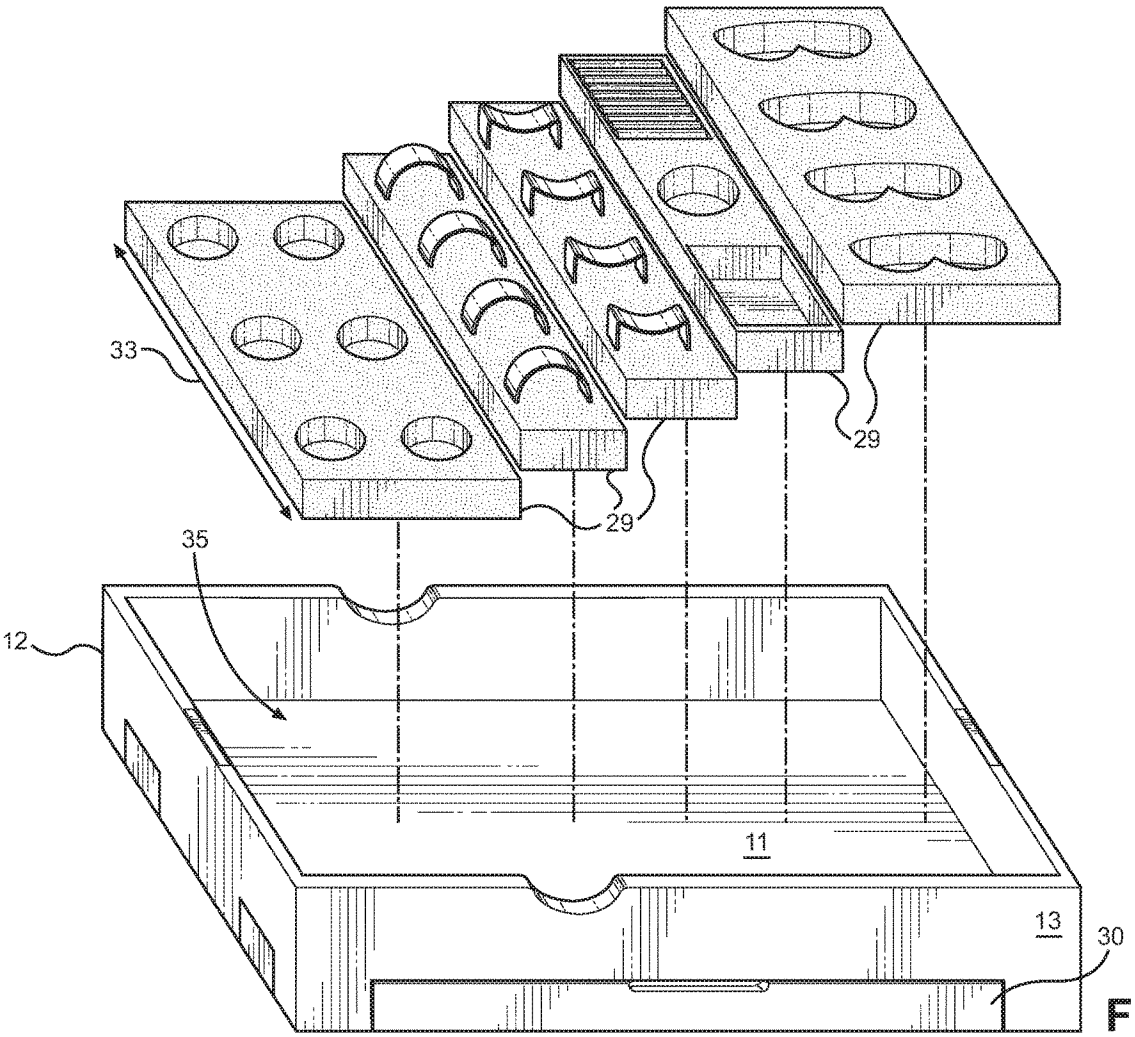
FIG. 1 shows a perspective view of one embodiment of the clothing accessory organization device with the storage compartments removed from the interior volume.

Reference is made herein to the attached drawings. Like reference numerals are used throughout the drawings to depict like or similar elements of the clothing accessory organization device. The figures are intended for representative purposes only and should not be considered to be limiting in any respect.

Figure 2:
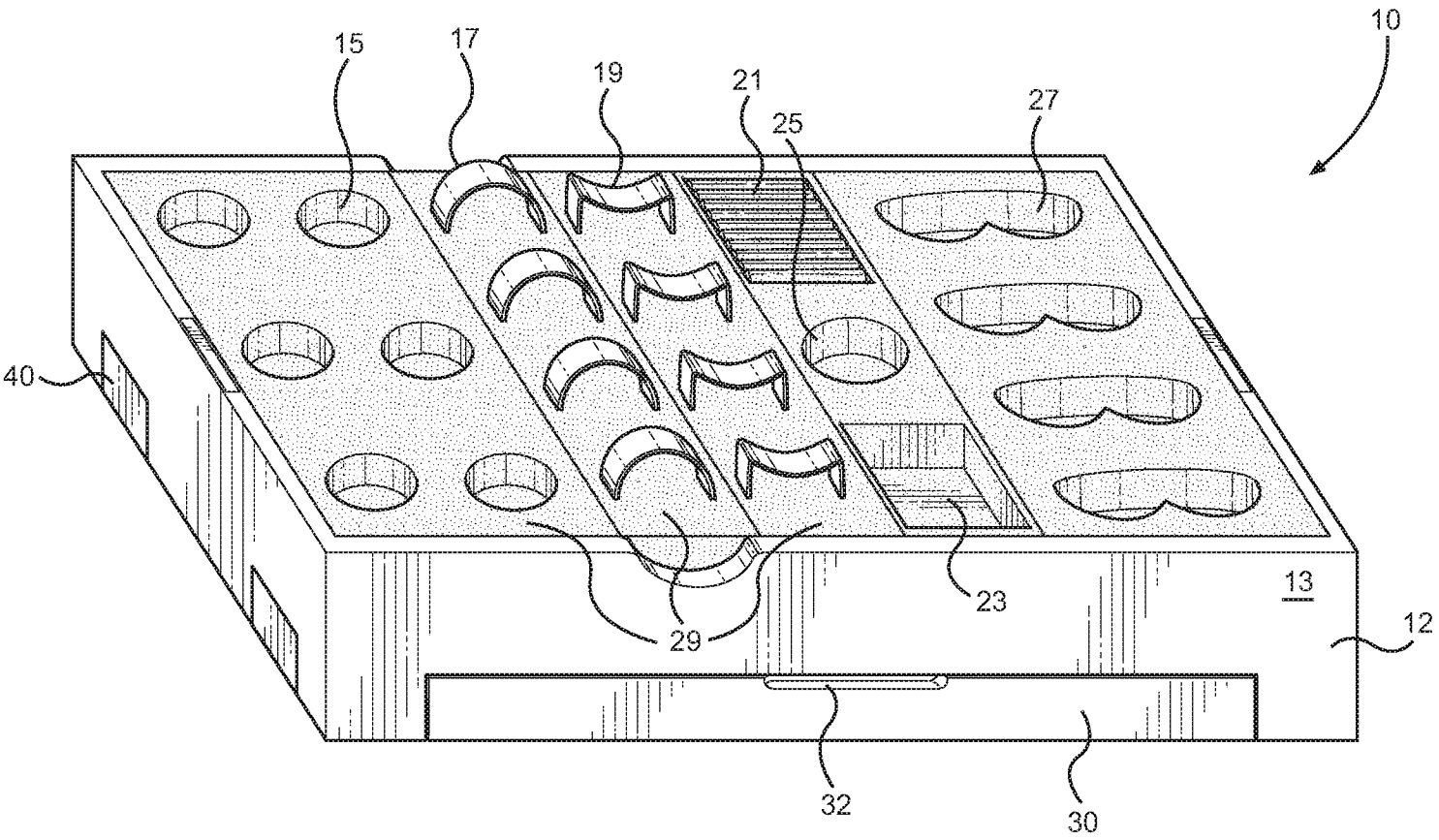
FIG. 2 shows a perspective view of one embodiment of the clothing accessory organization device.

Referring now to FIGS. 1 and 2, there is shown a perspective view of one embodiment of the clothing accessory organization device with the storage compartments removed from the interior volume and a perspective view of one embodiment of the clothing accessory organization device, respectively. The clothing accessory organization device 10 comprises a housing 12 having a base 11 and one or more sidewalls 13 forming an interior volume 35 with an open upper end. A plurality of storage compartments 29 is removably disposed within the interior volume 35. In some embodiments of the clothing accessory organization device 10, a drawer 30 is placed within the housing 12 with a front face of the drawer 30 flush with a sidewall 13, wherein the drawer 30 is slidably engaged with the housing 12, offering additional storage space.

The plurality of storage compartments 29 is interchangeable and modular with one another and may be removed from the interior volume 35 by lifting each one away from the housing 12. For example, each of the plurality of storage compartments 29 may comprise a rectangular shape, each having the same length 33 along one dimension of the compartment 29. Accordingly, the position of one storage compartment 29 may be swapped with the position of a substantially similar storage compartment 29. The dimensions of the perimeter of the interior volume 35 correspond to the total perimeter of the plurality of storage compartments 29 when positioned together. This allows a user to customize the configuration of the clothing accessory organization device 10 according to their needs.

Referring specifically to FIG. 2, the storage compartments 29 are configured to hold various clothing accessories within a number of recesses disposed along a top surface of the storage compartments 29. In some embodiments of the clothing accessory organization device 10, the storage compartments 29 comprises a non-slip material, such that the recesses 15 are configured to frictionally engage with clothing accessories, thus securely storing items therein. The recesses 15 comprise various shapes to accommodate a wide range of accessories. In a one embodiment of the storage compartment 29, the recesses 15 comprise a circular shape 25, adapted to fit rolled up belts therein. In a further embodiment, the recesses 15 comprise the contour of a pair of eyeglasses 27. In yet a further embodiment, the recess 15 includes a rectangular 23 shape. In yet a further embodiment, the recess 15 includes a plurality of grooves 21 arranged in a parallel configuration and adapted to hold rings or jewelry bands and other small objects therein. Additional embodiments include frames 17 and 19 designed to have a watch or a bracelet securely placed thereon.

Figure 3:
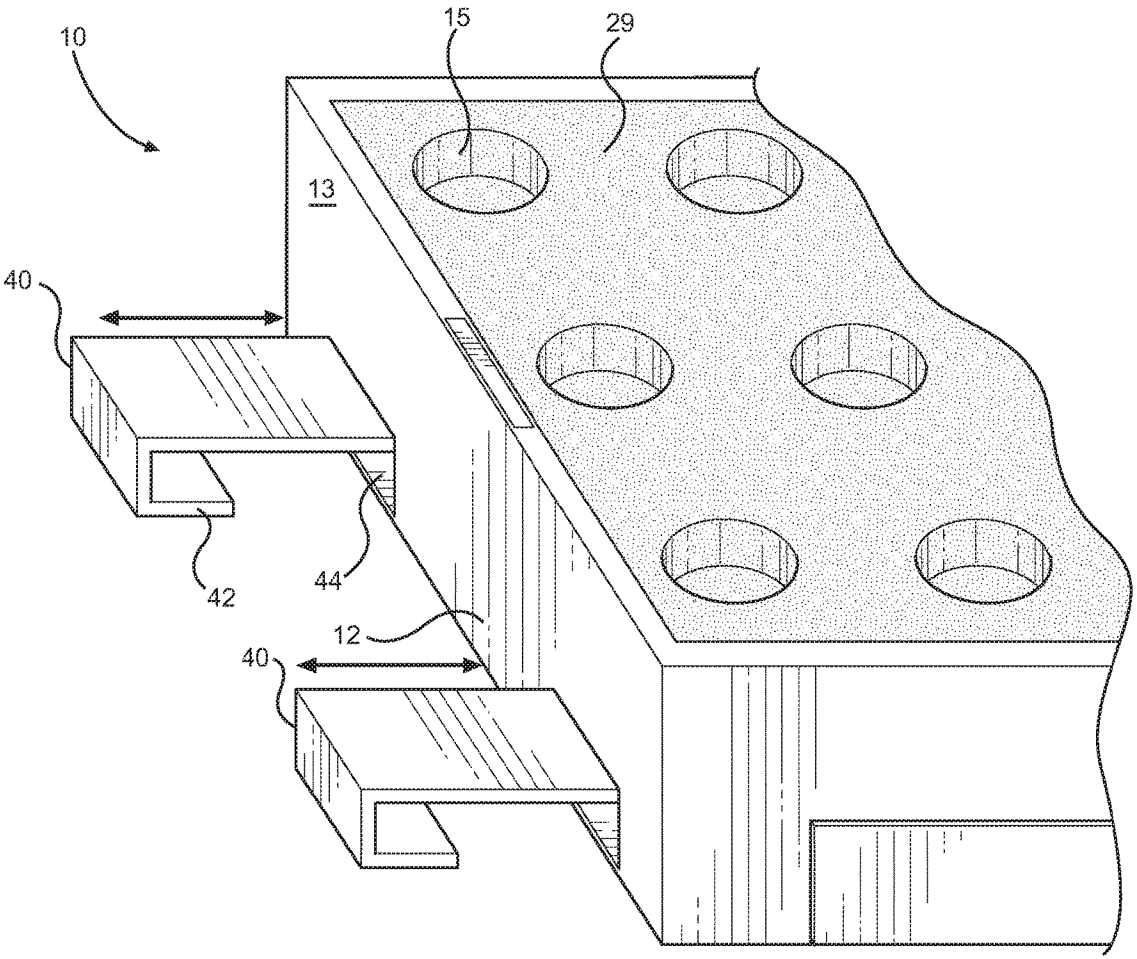
FIG. 3 shows a perspective view of the J-shaped hooks of the clothing accessory organization device in an extended position.

Referring now to FIG. 3 there is shown a perspective view of the J-shaped hooks of the clothing accessory organization device in an extended position. One or more retractable J-shaped hooks 40 are disposed within the housing 12 of the clothing accessory organization device 10. The hooks 40 are configured to slide between a retracted position within one or more apertures 44 disposed within the housing 12 and an extended positioned exterior to the housing 12. The hooks 40 comprise a lip 42 that is adapted to engage with flat surface. For example, the hooks 40 may be placed over the top of a door, such that the planar axis of the base 11 of the clothing accessory organization device 10 is placed parallel to a side surface of the door. As the recesses 15 of the storage compartment 29 are designed to frictionally secure clothing accessories therein, the accessories are held in place even when situated in a vertical position.

In addition to being hung in a vertical position, the clothing accessory organization device 10 may be used in a horizontal position. For example, a user may place the clothing accessory organization device 10 within a drawer or on the top surface of a dresser for easy access to the clothing accessory items stored therein. Some embodiments may additionally include a cover hingedly attached to the housing 12 and adapted to cover the open upper end to protect the stored accessories.

Figure 4:
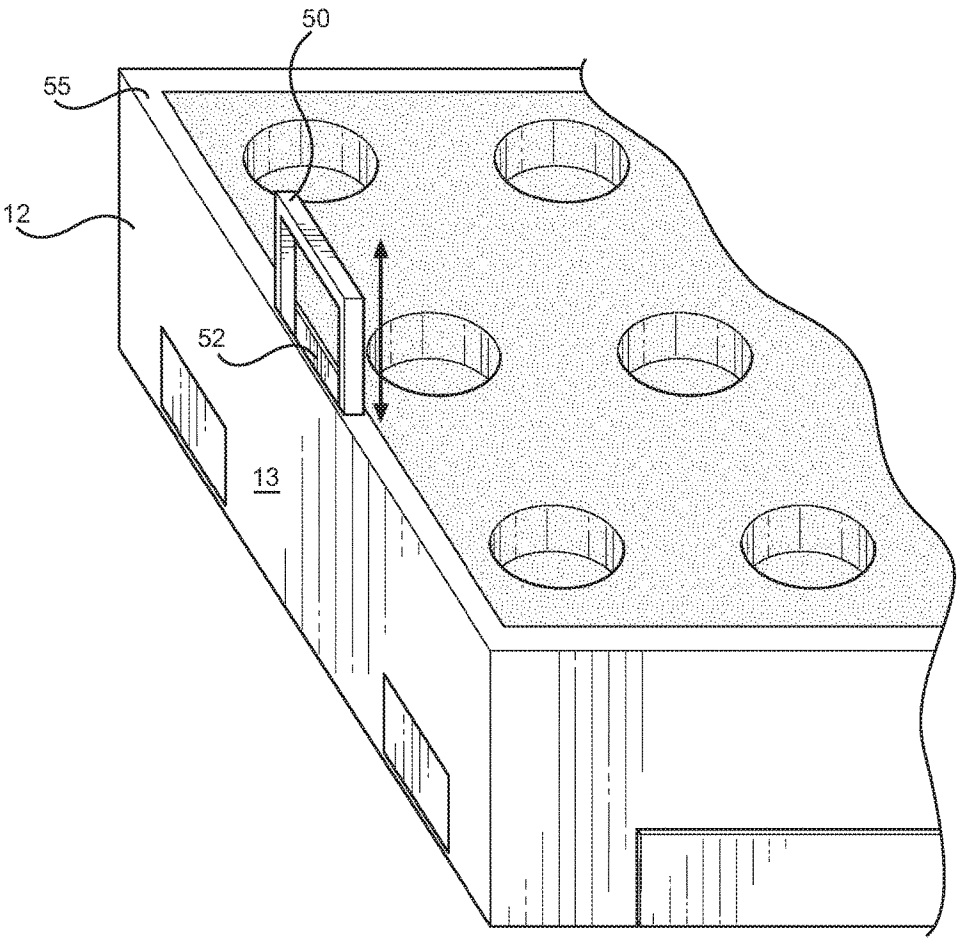
FIG. 4 shows a perspective view of a handle of the clothing accessory organization device in an extended position.

Referring now to FIG. 4 there is shown a perspective view of a handle of the clothing accessory organization device in an extended position. The clothing accessory organization device 10 further comprises one or more retractable handles 50 configured to slide between a stowed position within a sidewall 13 and a working position exterior to the sidewall 13. In one embodiment, the retractable handle 50 extends from a cavity 52 having an opening positioned along an upper ledge 55 of a sidewall 13. In the extended position, the retractable handle 50 engages with the housing 12 and cannot be extended further, thus allowing for easy transportation of the clothing accessory organization device 10 when so desired.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A clothing accessory organization device, comprising:

a housing including a base, one or more sidewalls, and an open upper end defining an interior volume;

one or more retractable J-shaped hooks configured to slide between a retracted position within one or more corresponding apertures of the housing and an extended position exterior to the housing;

a plurality of storage compartments that are each removably disposed within the interior volume of the housing, wherein the plurality of storage compartments is configured to store clothing accessories therein;

wherein the plurality of storage compartments is modular, such that an arrangement of the plurality of storage compartments is selectively reconfigurable within the interior volume, such that a storage compartment is interchangeable with another;

wherein the perimeter of the plurality of storage compartments when placed together corresponds to a perimeter of the interior volume.

2. The clothing accessory organization device of claim 1, wherein the one or more retractable J-shaped hooks extend from the one or more apertures positioned on the one or more sidewalls.

3. The clothing accessory organization device of claim 1, further comprising a retractable handle configured to slide between a stowed position within the sidewall and a working position positioned exterior to the sidewall.

4. The clothing accessory organization device of claim 1, wherein the plurality of storage compartments further comprises a surface having one or more recesses disposed thereon.

5. The clothing accessory organization device of claim 4, wherein the one or more recesses are circular.

6. The clothing accessory organization device of claim 4, wherein the one or more recesses are rectangular.

7. The clothing accessory organization device of claim 4, wherein the one or more recesses further comprises a plurality of grooves configured to frictionally engage jewelry bands therein.

8. The clothing accessory organization device of claim 4, wherein the one or more recesses are dimensioned to receive eyeglasses therein.

9. The clothing accessory organization device of claim 4, further comprising a rounded frame configured to a secure a wristwatch or bracelet thereon, such that the rounded frame comprises a concave form or a convex form.

10. The clothing accessory organization device of claim 4, wherein the plurality of storage compartments comprises a non-slip material.

11. The clothing accessory organization device of claim 4, wherein a storage compartment of the plurality of storage compartments comprises a plurality of differently shaped recesses configured to receive a plurality of differently shaped clothing accessories therein.

12. The clothing accessory organization device of claim 1, further comprising a drawer disposed within the housing and slidably engaged with the housing, the drawer having a front face flush with the one or more sidewalls.

13. The clothing accessory organization device of claim 1, wherein the plurality of storage compartments includes five storage compartments.

14. The clothing accessory organization device of claim 1, wherein the one or more J-shaped hooks comprise a lip that is adapted to engage with a flat surface of a door.

15. The clothing accessory organization device of claim 14, wherein a planar axis of the base of the housing is placed parallel to a side surface of the door when the one or more J-shaped hooks are engaged with the flat surface.

* * * * *